United States Patent [19]

Peterson

[11] 4,214,336

[45] Jul. 29, 1980

[54] TRASH PICKING DEVICE

[76] Inventor: Lloyd D. Peterson, 11546 Zea St., NW., Coon Rapids, Minn. 55433

[21] Appl. No.: 479

[22] Filed: Jan. 2, 1979

[51] Int. Cl.[2] ..... E01H 1/00; E01H 12/00

[52] U.S. Cl. ..... 15/3; 15/84; 56/328 R; 171/63

[58] Field of Search ..... 15/79 R, 3, 82, 83, 15/84, 85, 86; 56/328 R, 344, 345, 351, 358, 359, 400.03; 171/63

[56] References Cited

U.S. PATENT DOCUMENTS

| | | | |
|---|---|---|---|
| 296,591 | 4/1884 | Macy et al. | 56/358 |
| 566,308 | 8/1896 | Graham | 56/358 |
| 808,073 | 12/1905 | Culver | 56/358 |
| 947,963 | 2/1910 | Cable | 15/84 |
| 949,104 | 2/1910 | Warrenfeltz | 15/79 R X |
| 1,212,183 | 1/1917 | Brumbaugh | 15/84 |
| 3,802,022 | 4/1974 | Fleming | 15/84 |

*Primary Examiner*—Edward L. Roberts
*Attorney, Agent, or Firm*—Howard I. Podell

[57] ABSTRACT

A trash picking device including a self-propelled vehicle having a receiving tank therein with an entrance for receiving litter from a conveyor belt litter picked up by spiked rollers mounted on a support tower by the vehicle and communicating with the conveyor belt by means of a flexible chute. Preferably, two side rollers are pivoted to a central roller journalled directly below the conveyor belt. A pair of transporting wheels are pivotally mounted below the central roller. This roller drivingly engages the bottom roller of the conveyor belt.

8 Claims, 6 Drawing Figures

TRASH PICKING DEVICE

FIELD OF THE INVENTION

This invention relates generally to a device for picking up litter without collecting grass and leaves.

DESCRIPTION OF THE PRIOR ART

The prior art, as exemplified by U.S. Pat. Nos. 492,763; 1,144,292; 971,158; 494,660; 656,210; and 3,189,932 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusal skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the methods, processes, instrumentalities and combinations particularly pointed out in the appended claims.

SUMMARY OF THE INVENTION

This invention resides in a trash picking device including a self-propelled vehicle having a receiving tank therein with an entrance for receiving litter from a conveyor belt litter picked up by spiked rollers mounted on a support tower by the vehicle and communicating with the conveyor belt by means of a flexible chute. Preferably, two side rollers are pivoted to a central roller journalled directly below the conveyor belt. A pair of transporting wheels are pivotally mounted below the central roller. This roller drivingly engages the bottom roller of the conveyor belt.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
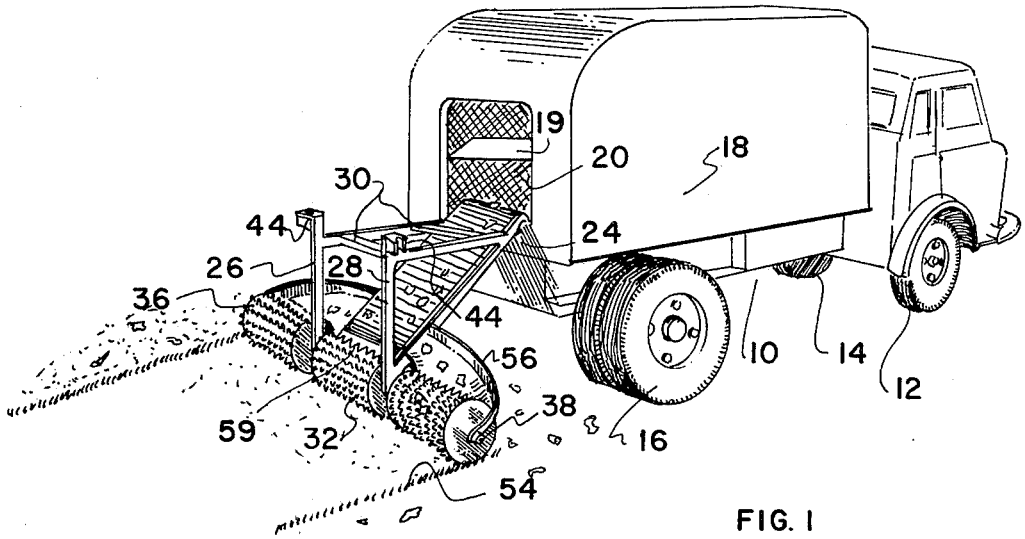
FIG. 1 is a view in perspective of the device in use.
Figure 2:
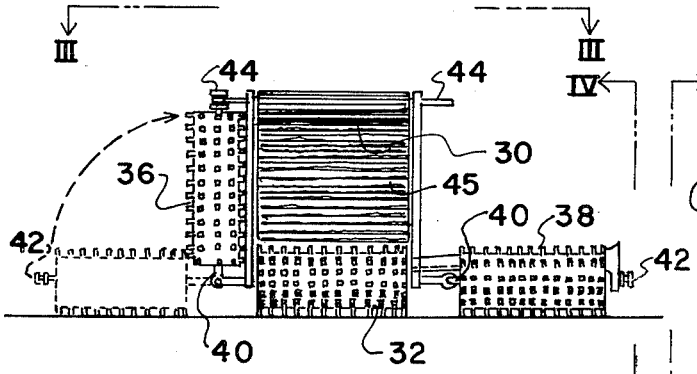
FIG. 2 is a front elevation of the litter pick up attachment.
Figure 4:
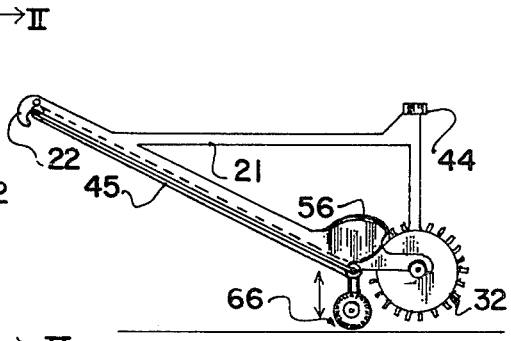
FIG. 4 is a cross-sectional view taken along line IV—IV of FIG. 2.

With reference to the drawing, there is shown and illustrated a litter picking device constructed in accordance with the principles of the invention. The illustrated tangible embodiment of the invention includes a vehicle or truck 10 having front ground wheels 12, 14 and rear dual wheels 16. The vehicle is powered by a front engine and has a collecting container 18 or compactor 19 provided with an entrance 20 in the rear part thereof.

A litter pick up unit is attached to and extends rearwardly from the rear end of the vehicle. The unit includes a support 21 having a hooked upper end 22 for detachably securing the unit to the bottom wall 24 of opening 20. The support has a pair of spaced triangular braces 26, 28 interconnected by rods 30. A first spiked roller 32 is mounted on an axle having gears 34 at their extremities and journalled between the lower ends of the braces 26, 28. A pair of similar rollers 36, 38 are mounted on axles 40 which have their inward end vertically pivoted to the outer ends of the axle mounting central roller 32. The outward ends of axles 40 have a stop 42 for engaging slotted catches 44 in the upper ends of braces 26, 28 when not in operation.

Figure 3:
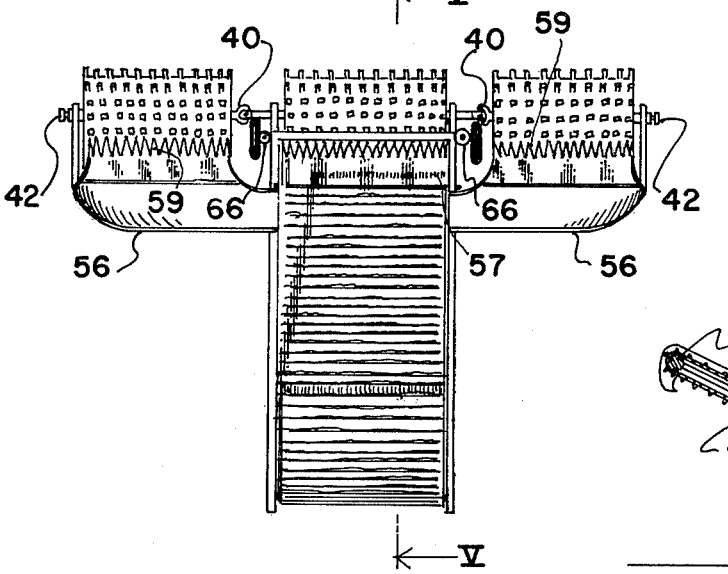
FIG. 3 is a top plan view of same taken along line III—III of FIG. 2.

A conveyor belt 45 is stretched between rollers 46, 48 rotatably mounted between top and bottom of the braces 26, 28 and forming an upwardly inclined diagonal. Roller 48 has a gear 50 on each side connected by chains 52 in order to cause belt 45 to ascent as spiked roller 32 rotates along the ground 54 (FIG. 1). A foldable skirt or deflector 56 of flexible material is secured below the side rollers 36, 38 and extends to the sides of braces 26 and 28 above the conveyor belt 45 for dropping thereon debris 58 picked up by the side rollers 36, 38. A fixed deflector 57 is similarly secured below central roller 32. Deflectors 56 and 57 are shaped with serrated forward edges 59 located to fit between the spikes of rollers 32, 36 and 38 as shown in FIG. 3 so as to strip debris, that has been punctured by the spikes, off of the roller spikes and onto the deflectors 56, 57 and then directly onto the conveyor belt for transfer into tank 18.

Figure 6:
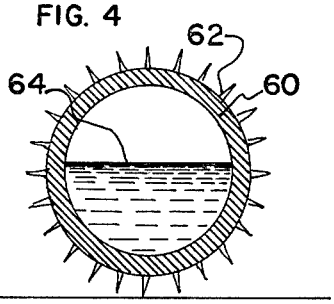
FIG. 6 is a cross-sectional view taken through one of the rollers.
Figure 5:
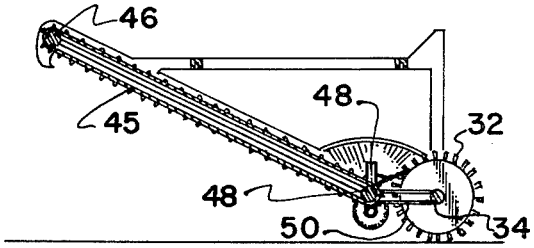
FIG. 5 is a cross-sectional view taken along line V—V of FIG. 3.

FIG. 6 shows a section through one of the spiked rollers and shows same as comprising a cylindrical body 60 of hard, resilient rubber formed with peripheral spikes 62 and partially filled with ballast such as water 64. This construction allows the rollers to pick up litter only and to leave behind grass and leaves. Thus, the rollers will puncture thin metal, paper and wedge some bottles so as to pick them up.

Transfer wheels 66 are foldably mounted by leg 68 under the central cylinder and can be jacked up or down as required.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention.

Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. In a self propelled trash pick up vehicle having a trash receiving area provided with an entrance, an attachable collecting device comprising a support structure, an upper end section of which is adapted to be secured to said entrance; a central spiked roller rotatably mounted at a lower end section of said support structure; an endless belt movable between said lower end and said upper end sections that is drivingly connected to said central roller for conveying litter picked up by projecting spaced spikes of said roller into said receiving area, together with stripper means associated with the lower end section of the support structure for removal of said litter from said spikes and onto said belt, with the spikes of said roller resting on a ground surface, when the collecting device is attached to the vehicle, so as to support the roller, in the position of use.

2. The invention as recited in claim 1, wherein said roller consists of a hollow rubber member adaptable for containing water ballast.

3. The invention as recited in claim 1, further including a pair of transporting wheels foldably mounted under said central cylinder.

4. The invention as recited in claim 1, wherein said vehicle includes a compactor.

5. The invention as recited in claim 1, further including a pair of spiked side rollers, means pivotally mounting each side roller relative to said central roller, said pivotal means permitting each said side roller to be pivoted to a first position for use in which the side rollers extend on each lateral side of the central roller and rest on a ground surface, and permitting each said side roller to be pivoted to a second position for storage in which the side rollers are pivoted so that each side roller is removed from the ground surface and extends along a substantially vertical axis, with deflecting means stretched behind said side rollers to points above said endless belt at the lower end of said belt for transferring thereto debris picked up by said side rollers, and with each said deflecting means fitted with stripper means for stripping debris and litter from spikes of the associated side roller.

6. The invention as recited in claim 5, further including locking means above said central roller for securing thereto the ends of said side rollers in the said second position.

7. The invention as recited in claim 5 in which spikes of said side rollers are formed of a resilient material such as rubber.

8. The invention as recited in claim 1 wherein spikes of said roller are formed of a resilient material such as rubber.

* * * * *